US006496797B1

(12) United States Patent
Redkov et al.

(10) Patent No.: US 6,496,797 B1
(45) Date of Patent: Dec. 17, 2002

(54) APPARATUS AND METHOD OF SPEECH CODING AND DECODING USING MULTIPLE FRAMES

(75) Inventors: Victor V. Redkov, Petersburg (RU); Anatoli I. Tikhotski, Petersburg (RU); Alexandr L. Maiboroda, Petersburg (RU); Eugene V. Djourinski, Petersburg (RU)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/283,578

(22) Filed: Apr. 1, 1999

(51) Int. Cl.[7] ..... G10L 19/08
(52) U.S. Cl. ..... 704/220; 704/223
(58) Field of Search ..... 704/208, 221, 704/223, 220

(56) References Cited

U.S. PATENT DOCUMENTS

| | | | | | |
|---|---|---|---|---|---|
| 4,677,671 | A | * | 6/1987 | Galand et al. | 704/212 |
| 5,115,469 | A | * | 5/1992 | Taniguchi et al. | 704/228 |
| 5,574,823 | A | * | 11/1996 | Hassanein et al. | 704/208 |
| 5,890,108 | A | * | 3/1999 | Yeldener | 704/208 |
| RE36,478 | E | * | 12/1999 | McAulay et al. | 704/206 |
| 6,233,550 | B1 | * | 5/2001 | Gersho et al. | 704/208 |

OTHER PUBLICATIONS

Daniel W. Griffin et al, IEEE Transactions on Acoustics, Speech, and Signal Processing, vol. 36, No. 8, Aug. 1988, pp. 1223–1235.

* cited by examiner

*Primary Examiner*—Vijay Chawan
*Assistant Examiner*—Donald L. Storm
(74) *Attorney, Agent, or Firm*—Birch, Stewart, Kolasch & Birch, LLP

(57) ABSTRACT

An apparatus and method for speech compression includes dividing the speech spectrum into a plurality of frames, assigning frame classifications to the plurality of frames, and determining the speech modeling parameters based on the assigned frame classification. The voiced part of the speech spectrum and the unvoiced part of the speech spectrum are synthesized separately using an Analysis by Synthesis allowing a correct correspondence between voiced and unvoiced parts of the reconstructed signal. Particularly, a frequency response of a special simulated signal based on the previous and current frames is used as an approximating function. The simulated signal is synthesized at the encoder side in the way it will be generated at the decoder side. Also, a better of two encoding methods is selected to encode the spectral magnitudes. A wavelet encoder and an inter-frame predictive encoder illustrate the invention's efficient, yet accurate reconstruction of synthesized digital speech.

31 Claims, 11 Drawing Sheets

APPARATUS AND METHOD OF SPEECH CODING AND DECODING USING MULTIPLE FRAMES

FIELD OF THE INVENTION

The present inventions relate to a communication system and more particularly to a speech compression method for a communication system.

DISCUSSION OF THE RELATED ART

Many speech compression systems are known. Generally, these systems may be divided into three types: time domain, frequency domain and hybrid codecs. However, in case of the low bit-rate coding, multi-band excitation (MBE) compression technique provides the best quality of the decoded speech.

The MBE vocoders encode the obtained speech signal by first dividing the input speech into constrained frames. These frames are transformed from the time domain to the frequency domain. Thereafter, a frequency spectrum of the framed and windowed signal is calculated, and an analysis of the frequency spectrum is performed. Speech model parameters such as a pitch value, a set of voiced/unvoiced decisions for the frequency bands, a set of spectral magnitudes and corresponding phase values are necessary for the speech synthesis in MBE vocoders. Usually, the phase values are not transmitted for low bit-rate coding.

There are numerous ways of spectrum approximation, all of which are based on an approximation of the frequency bands by some excitation function. The most traditional kind of an excitation function is a frequency response of the Hamming window. However, the Hamming window only obtains a good approximation of the original spectrum for stationary speech signals. For non-stationary speech signals, a predetermined kind of excitations function does not match well enough to the real shape of the spectrum for an accurate approximation. For example, a pitch frequency change during the analysis period may cause a widening of the peaks in the spectral magnitude envelope. Thus, the width of the peaks of the predetermined excitation function would no longer correspond to the width of the real peaks. Moreover, if the analyzed speech frame is a blend of two different processes, the spectrum would have a very complex shape, which is rather difficult to accurately approximate by means of a predetermined simple excitation function.

There are also many techniques for encoding the MBE parameters. Typically, a simple scalar quantization is used for encoding a pitch value and a band grouping method is used for encoding the voiced/unvoiced decisions. The most difficult task is the encoding of the spectral magnitudes, for which a Vector Quantization (VQ), a Linear Prediction and the like are used. Numerous high efficiency compression methods have been proposed based on VQ, one of which is a method of hierarchical structured codebook used for encoding spectral magnitudes.

Although the VQ technique allows an accurate quantizing in some problem area, it is generally effective for data close to those which has been included in the "learning sequences". Other effective methods for encoding spectral magnitudes are intra-frame and inter-frame linear prediction. The intra-frame method allows for an adequate encoding of spectral magnitudes, but its effectiveness is substantially deteriorated at low bit-rate coding. The inter-frame prediction method is also fairly good, but its usage is reasonable only for stationary speech signals.

The speech synthesis in the related art is carried out according to an accepted speech model. Generally, the two components of the MBE vocoders, the voiced and unvoiced parts of speech, are synthesized separately and combined later to produce a complete speech signal.

The unvoiced component of the speech is generated for the frequency bands, which are determined to be unvoiced. For each speech frame, a block of random noise is windowed and transformed to the frequency domain, wherein the regions of the spectrum corresponding to the voiced harmonics are set to zero. The remaining spectral components corresponding to the unvoiced parts of speech are normalized to the unvoiced harmonic magnitudes.

A different technique is used for generating the voiced component of the speech in the MBE approach. Since the voiced speech is modeled by its individual harmonics in the frequency domain, it can be implemented at the decoder as a bank of tuned oscillators. An oscillator is defined by its amplitude, frequency and phase, and is assigned to each harmonic in the voiced regions of a frame.

However, the variations in the estimated parameters of the adjacent frames may cause discontinuities at the edges of the frames, resulting in a significant degradation of speech quality. Thus, during the synthesis, both the current and previous frames' parameters are interpolated to ensure a smooth transition at the frame boundaries, resulting in a continuous voiced speech at the frame boundaries.

Different implementations of interpolation schemes (for amplitude, frequency and phase) are possible. However, the interpolation schemes are generally only satisfactory under steady pitch. In case of sharp changing pitch, implementing processing rules do not lead to satisfactory results due to the traditional lacing of harmonics relating to the same number of frequency bands of the neighboring speech frames. In case of a pitch frequency change, a difference of frequencies of the laced harmonics appears and under conventional correspondence of harmonic bands, this difference is more significant for higher band numbers and for higher degree of pitch change. As a result, annoying artifacts in the decoded speech appear.

SUMMARY OF THE INVENTION

Accordingly, an object of the present invention is to solve at least the problems and disadvantages of the related art.

Another object of the present invention is to provide a method, which improves the quality of the speech spectrum approximation, for both voiced and unvoiced bands.

Another object of the present invention is to improve the encoding efficiency of the spectral magnitude set, regardless of the bit-rate for encoding.

A further object of the present invention is to improve the quality of speech synthesis.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

To achieve the objects and in accordance with the purposes of the invention, as embodied and broadly described herein, the speech spectrum approximation is performed on the spectrum divided into plural bands according to the pitch frequency of the speech frame. The pitch frequency of the speech signal is determined, the frequency bands are built, and a voiced/unvoiced discrimination of the frequency bands is performed. Thereafter, an Analysis by Synthesis method of the speech spectrum approximation is used for calculating the magnitudes.

A more precise evaluation of the harmonic magnitudes at the encoder side results in an increase of quality for the voiced part of the signal reconstruction at the decoder side. Also, a more precise calculation of magnitudes for the unvoiced bands of spectrum results in a quality increase for the noise part of the reconstructed signal. The usage of the Analysis by Synthesis method both for the voiced and unvoiced bands provides a correct correspondence between the voiced and unvoiced parts of the reconstructed signal.

Also, the present invention improves the encoding efficiency of the spectral magnitudes set. In case of the low bit-rate encoding, the problem is to represent the spectral magnitudes data by a fixed number of bits. The present invention with respect to the spectral magnitudes encoding is divided into two main tasks: to reduce an original quantity of spectral magnitudes to the fixed number and to encode the reduced set. The present method solves the first task effectively by usage of Wavelet Transform (WT). Also, applying an inter-frame prediction effectively solves the second task, if the speech signal is stationary.

However, at time intervals containing non-stationary signals, no prediction is rather effective. Applying the Wavelet Transform technique effectively solves the encoding task in this case. The increase of encoding efficiency allows either an improved quality of reconstructed speech signal under the same bit-rate or a reduced bit-rate required for the same quality level.

Furthermore, the present invention improves the quality of speech synthesis. The speech synthesis is carried out sequentially for every frame. As a fundamental frequency is a base of the whole band division of the spectrum to be approximated, a difference of frequencies of the laced harmonics appears in case of the pitch change. The present invention uses a frequency correspondence between the laced bands of current and previous frames. This provides a correct and reliable speech synthesis process in conditions of the pitch frequency changes and the pitch frequency jumps. Even obvious troubles (errors) of pitch determination do not lead to dramatic consequences as in conventional schemes.

BRIEF DESCRIPTION OF THE DRAWING

The invention will be described in detail with reference to the following drawings in which like reference numerals refer to like elements. wherein.

DETAILED DESCRIPTION OF THE PREFERRED EMBODIMENT

The preferred embodiments of the invention will be described in context of the MBE encoding scheme. The MBE vocoder has been disclosed by D. W. Griffin and J. S. Lim in "Multiband Excitation Vocoder," IEEE Transactions on Acoustics, Speech, and Signal Processing, vol. 36, No. 8, August 1988, pp. 1223–35, fully incorporated herein. Typically, the vocoder operates with a speech signal sampling rate of 8 kHz. An application of the speech signal encoder and decoder according to the present invention will be discussed below.

Figure 1:
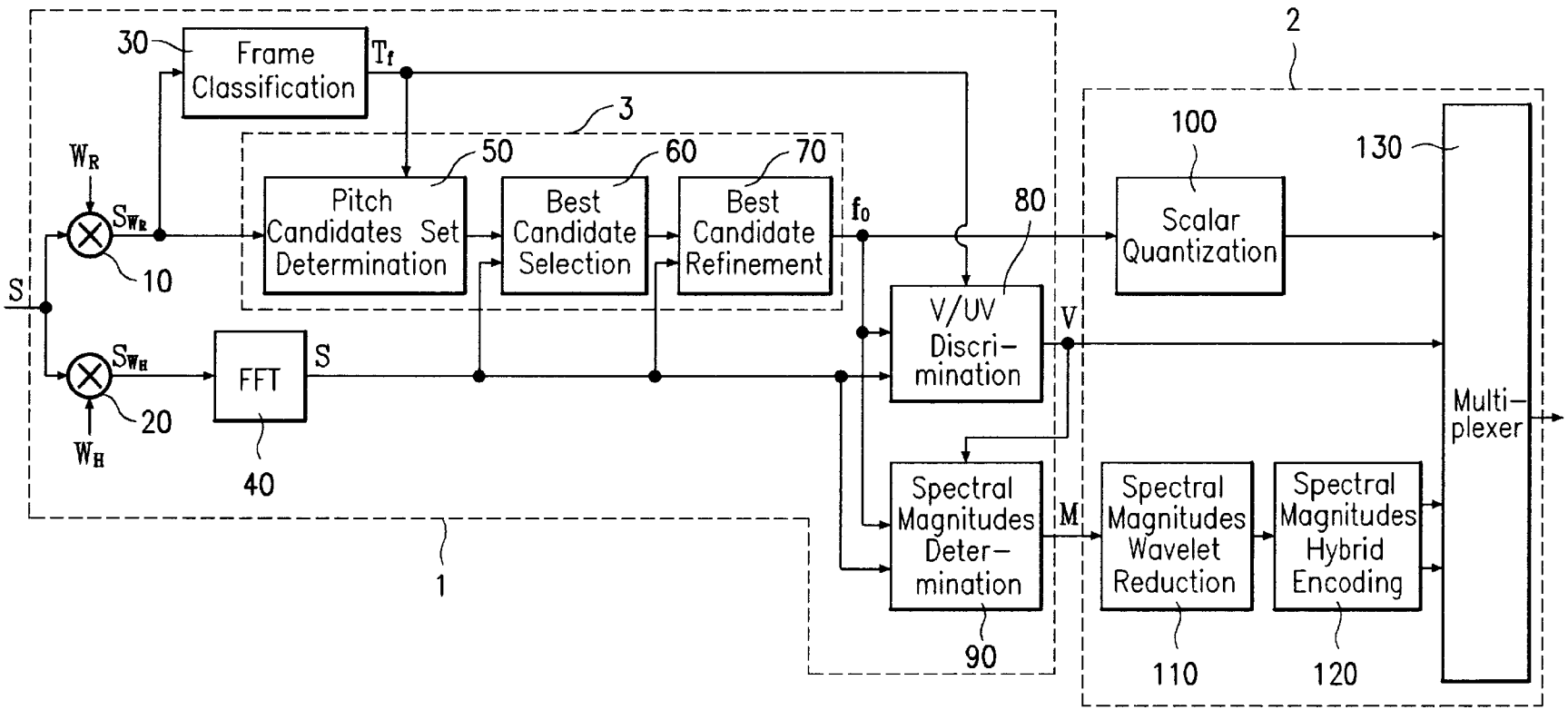
FIG. 1 is a block diagram of an encoder according to a preferred embodiment of the present invention.

FIG. 1 shows a preferred embodiment of an encoder according to the present invention. As shown, the encoder of the present invention includes a speech model parameter determination unit 1 and a parameter encoding unit 2. The speech model parameter determination unit 1 includes a Rectangular Windowing unit 10, a Hamming Windowing unit 20, a Frame Classification unit 30, a Fast Fourier Transform (FFT) unit 40, a Pitch Detection unit 3, a V/UV (Voiced/Unvoiced) Discrimination unit 80, and a Spectral Magnitudes Determination unit 90, all operatively coupled. These components are used for determining the MBE model parameters such as a pitch frequency fo, a set of voicing decisions V, a set of spectral magnitudes M, and phase values (due to a very low bit-rate, the phase values are not transmitted in the present embodiment).

The parameter encoding unit 2 includes a Scalar Quantization unit 100, a Spectral Magnitudes Wavelet Reduction unit 110, a Spectral Magnitudes Hybrid Encoding unit 120, and a Multiplexer unit 130. These components are used for encoding the MBE model parameters into a plurality of bits. Moreover, the Pitch Detection unit 3 includes a Pitch Candidates Set Determination unit 50, Best Candidate Selection unit 60, and a Best Candidate Refinement unit 70.

For the parameter determination, the speech signal is first divided into overlapping segments of 32 ms with an advance equal to 20–24 ms. At the Rectangular Windowing unit 10, the signal is multiplied by a rectangular window function $W_R$ for frame classification performed by the Frame Classification unit 30. At the Hamming Windowing unit 20, the signal is also multiplied by the Hamming window function $W_H$ for spectrum calculation performed by the FFT unit 40. To increase the frequency resolution, a series of zeroes are added to the processed frame before performing the FFT to produce a FFT_LENGTH array. A good frequency resolution may be achieved with the array FFT_LENGTH=2048, but for a real-time application, an array value of FFT_LENGTH=512 was used.

The Frame Classification unit 10 is an auxiliary unit relative to the MBE model in the related art. This unit processes the speech frame in the time domain and generates the frame classification characteristics $T_f$ used for a more reliable and robust signal processing at the Pitch Candidates Set Determination unit 50 and at the V/UV Discrimination unit 80. The frames are classified in two ways, first by a range and character of varying signal value along the frame, and second by the characters of the signal oscillation inside the frame.

In the first classification, the types of the signal in the frames were defined as shown in TABLE 1 below. This classification way is based upon a simultaneous study of the signal sample values and character changes inside the frame. Also, the types of the signal oscillation inside the frame were defined as shown in TABLE 2 below. This second classification way is based upon values of zero crossing the first and second parts of a current frame.

TABLE 1

(The first classification way of the speech frames)

| | |
|---|---|
| SILENCE | a very low amplitude frame where occasionally, single short noise peaks appear |
| FIZZLE | a rather low amplitude frame where systematic noise peaks appear |
| VOWEL | a pure vowel sound frame |
| VOWEL_FADING | a fading vowel sound frame |
| VOWEL_RISING | a rising vowel sound frame |
| PAST_VOWEL | a frame where a fading vowel sound appears only at the beginning of the frame |
| BEFORE_VOWEL | a frame where a rising vowel sound appears only at the end of the frame |
| CHAOS | all other types of the frames |

TABLE 2

(The second classification way of the speech frames)

| | |
|---|---|
| WELK | a frame containing no oscillation |
| VIBRATION | a frame containing oscillations both in the beginning and in the end |
| PAST_VIBRATION | a frame containing oscillations only in the beginning |
| BEFORE_VIBRATION | a frame containing oscillations only in the end |

As a result, 32 (i.e. 8×4) combined types of frames are derived and defined. A derived type of frame is specified from the combined types by means of logical operations. An example of the derived type of frame is as follows:

SOME_OF_VOWEL 'AND' 'NOT' SOME_OF_VIBRATION, where
SOME_OF_VOWEL=VOWEL
'OR' VOWEL_FADING
'OR' VOWEL_RISING
'OR' PAST_VOWEL
'OR' BEFORE_VOWEL, and
SOME_OF_VIBRATION=VIBRATION
'OR' PAST_VIBRATION
'OR' BEFORE_VIBRATION.

The obtained frame classification characteristics are used for the pitch detection and for the voicing discrimination. The operation of the Pitch Detection unit 3 utilizing the frame classification characteristics will next be discussed.

The problem of a reliable pitch frequency detection is paramount and is one of the most difficult tasks, especially for a real-time application. The pitch detection method of the present invention provides an effective and reliable solution based on the analysis in both time and frequency domains. The pitch frequency detection is performed in three stages. First, the Pitch Candidates Set Determination unit 50 determines the set of pitch candidates using an auto-correlation function (ACF) analysis in time domain. Second, the Best Candidate Selection unit 60 estimates all candidates in the frequency domain and a best candidate is selected. Thereafter, the Best Candidate Refinement unit 70 refines the best candidate value in the frequency domain.

A more reliable pitch detection can be obtained if the short-time center clipping is used before the calculation of the ACF. After the center clipping, the low-pass filtering of the processed frame is performed. Either direct or inverse order for the ACF calculation is used depending on the frame type determined by the Frame Classification unit 30. Although the same formula is used for both the direct and inverse orders for the ACF calculation, the direct order involves sample couples located in the beginning of the frame whereas the inverse order operates with sample couples located in the end of the frame. For example, the inverse order of ACF calculation is applied for frames of types VOWEL_RISING, BEFORE_VOWEL, etc. and the direct order of ACF calculation is used for frames of types VOWEL_FADING, PAST_VOWEL, etc.

The Pitch Candidates Set Determination unit 50 determines the pitch candidate set wherein the set of the candidates includes all the local maximums of the ACF located at the left side of the time lag corresponding to the global maximum ACF value. The set may include various numbers of the candidates for different frames. The range of the precise search in the frequency domain is defined by the frequency corresponding to the global maximum ACF value.

In the Best Candidate Selection unit 60, an estimation of every candidate from the obtained set is performed and the best candidate is selected. Particularly, the best value of the pitch frequency is found in a small vicinity of the pitch candidate value using the criterion of the minimum of the summarized square error (SSE) of the approximation with the weights. The approximation is performed in the frequency domain and the estimation of a quality approximation is performed as follows. According to the examined pitch frequency p, the whole frequency range is divided into n frequency bands with width p Hz. The speech spectrum in each band is approximated by the scaled Hamming window response and the SSE of the approximation is calculated by equation (1) below:

$$SSE = \sum_{i=1}^{n} SSE_i, \tag{1}$$

where $$SSE = \sum_{k=a_i}^{b_i} Q_i \cdot [S(k) - A_i \cdot W(k - a_i)]^2$$

The amplitude value $A_i$ for the i-th band is calculated as follows $$A_i = \frac{\sum_{k=a_i}^{b_i} S(k) \cdot W(k - a_i)}{\sum_{k=a_i}^{b_i} W^2(k - a_i)}, \quad (2)$$

where S is a speech spectrum, W is a scaled Hamming window response, $a_i$ and $b_i$ are numbers of harmonics corresponding to the beginning and the end of the: i-th band.

Traditionally, the Hamming window response with a constant width is used in the MBE scheme. However, extensive experiments show that using a fixed shape of the Hamming window response results in an unjustified odds for lower pitch frequencies (e.g. sub-harmonics of a true pitch value).

Figure 2:
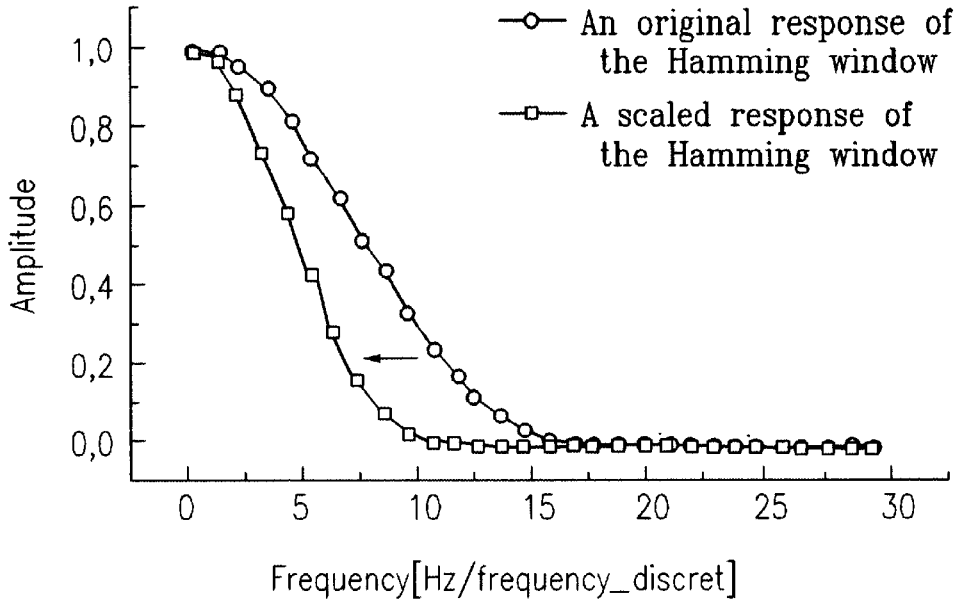
FIG. 2 illustrates the Hamming window response scaling.

In the preferred embodiment, a special scale factor corresponding to the examined pitch value is used for scaling the Hamming window response as shown in FIG. 2. The scaling is performed for frequencies lower than a fixed frequency $F_{scale}$. The value of the frequency $F_{scale}$=140 Hz was determined experimentally. Particularly, the scaling is performed as follows. For a given FFT_LENGTH value of the total number of harmonics in the spectrum obtained by a FFT transform, the original Hamming window response has $N_{orig}$ components deviating significantly from zero. For FFT_LENGTH=2048, Nong was accepted to be equal to 31. For low fundamental frequencies $F_{0exam}<F_{scale}$, a scaled Hamming window response used as an excitation function should have a sharper shape.

Therefore, the array of the response values should have $N_0<N_{orig}$ components deviating significantly from zero. The number of these component $N_0$ is calculated as follows $N_0=\text{int}[N_{orig}(\text{FFT_LENGTH}/2048)\cdot(F_{0exam}/F_{scale})]$. A procedure of the proportional sharpening based upon a linear interpolation is applied to the original Hamming window response in order to obtain a scaled response.

The present invention results in a better approximation of the frequency bands corresponding to low pitch frequency. The adequate sharpness of the approximating function in every band provides the true pitch candidate selection. For real-time application, all scaled Hamming window responses corresponding to different $F_{0exam}<F_{scale}$ may be tabled and may be used as a look-up table. On the other hand, to avoid giving unjustified odds at higher pitch frequencies (e.g. multiple harmonics of true pitch value), the first band is expanded under the SSE, calculation compared with other bands, such that $a_1$=1.

However, during the best candidate selection, the importance of the different parts of the spectra may be unequal. In consideration of this problem, the weight coefficients Q are introduced into the SSE calculation. A piecewise-linear weight Q was used as in equation (3) below $$Q_k = \begin{cases} 1, & 0 < k \le bf; \\ (ef - k)/(ef - bf), & bf < k \le ef; \\ 0, & \text{otherwise}; \end{cases} \quad (3)$$

where bf is a harmonic number corresponding to the beginning of the weights' fading and ef is a harmonic number corresponding to end of the weights' fading and where ($0 \leqq bf<ef$). The obtained value of the best pitch frequency is refined in the Best Candidate Refinement unit 70 by finding the best value of the pitch frequency within a small vicinity of the pitch candidate value using a minimum of the approximation without weights.

An important feature of the MBE approach is a generation of the voiced/unvoiced decisions for every frequency band of the original spectrum rather than for the whole frame. Also, the harmonic components may exist in a fricative frame and the vocal frame may contain some noise bands. The generation of voiced/unvoiced decisions for every frequency band of the original spectrum is carried out in the V/UV Discrimination unit 80. For a low bit-rate implementation of the MBE vocoder, the generation of decisions is performed on groups of the adjacent frequency bands. The adaptive band division (relatively to the bands' number value) is used in the preferred-embodiment.

The voicing discrimination process starts when a predetermined value of the pitch is obtained. For the discrimination, the original spectrum is divided into frequency bands according to the predetermined pitch value and every frequency band is approximated by the scaled frequency response of the Hamming window. Also, the frequency response scaling is performed for the same reason and by the same technique as was described in the Best Candidate Selection unit 60. The scaling provides a correct relation between the width of the frequency band and the approximating window. Moreover, it is very important to correctly adjust the position of the approximating window and the location of the frequency band peak.

The value of the Noise to Signal Ratio (NSR) of the approximation quality defines the voiced/unvoiced property of a frequency band group. The threshold of the NSR value depends on the classification characteristics of the current frame. For example, if the amplitude characteristic of a frame belongs to both the VOWEL types and but does not belong to any type of VIBRATION, the threshold is increased by a factor of √2, forcing the voiced decisions for evident voiced frames. However, for evident consonant frames when the amplitude characteristic of a frame does not belong to the VOWEL types but belongs to one of the VIBRATION types, the threshold is decreased by a divisor equal to √2, forcing the unvoiced decisions for evident consonant frames. If the classification is unclear, the threshold value is not changed and has a predefined value.

The estimation of the approximation quality incorporating the NSR is calculated by the following equation (4):

$$NSR_i = \frac{\sum_{m=n_i}^{n_{i+1}-1} Err_m}{\sum_{k=a_i}^{b_i} ([S(k)])^2}, \quad (4)$$

where $NSR_i$ is a noise to signal ratio of i-th band group, including bands from $n_i$ to $n_{i+1}-1$, wherein $n_i$ is a band number of the first frequency band in the i-th group; $Err_m$ is a summarized square error of the approximation for the m-th band; S(k) is a magnitude of the k-th harmonic of the approximated spectrum; $a_i$ and $b_i$ are harmonic numbers corresponding to the beginning and the end of i-th band group, wherein $a_i$ is a harmonic number of the first harmonic in $n_i$-th band and $b_i$ is a harmonic number of the last harmonic in $(n_{i+1}-1)$-th band.

A determination of $Err_m$ is performed separately for every band included in the group. For the determination, a position tuning of the scaled Hamming window response relatively to the frequency band peak is performed for the voiced frames. This provides a correct voiced/unvoiced decision generation and is made by the following way. The $Err_m$ value is calculated for various positions of the approximating window, relatively to the center of the frequency band.

Thereafter, the position of the approximating window corresponding to the minimal $Err_m$ value is selected and the best $NSR_i$ value for the whole band group is obtained from the minimal $Err_m$ values for every band included in the group. Thus, the voiced/unvoiced decision is generated by means of the NSR criterion as discussed above.

The determination of the spectral magnitudes using the AbS (Analysis by Synthesis approach will be next described. Generally, a purpose of analyzing and coding operations is to obtain at the sending side the data required for speech generating at the receiving side. According to the MBE model, a speech generation is performed with the speech model parameters including a pitch value, which induces a harmonic band system; a set of voiced/unvoiced decisions for the frequency bands; a set of spectral amplitudes; and corresponding phase values.

Figure 3:
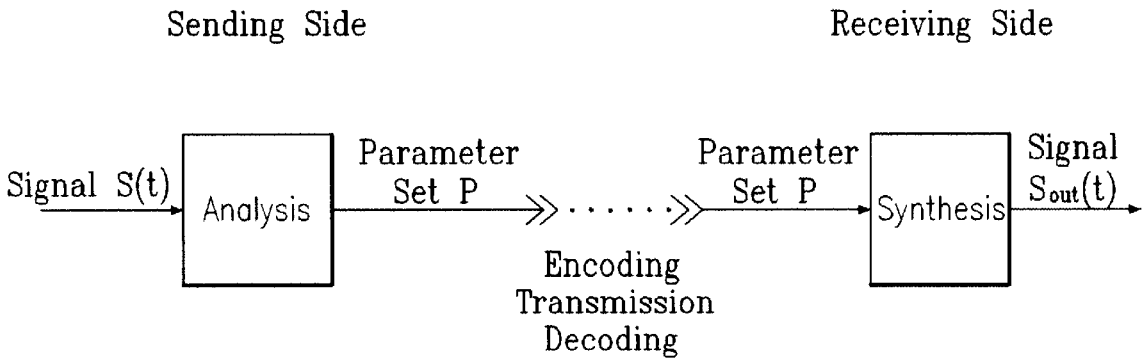
FIG. 3 illustrates a direct method of the speech model parameters determination according to the present invention.
Figure 4:
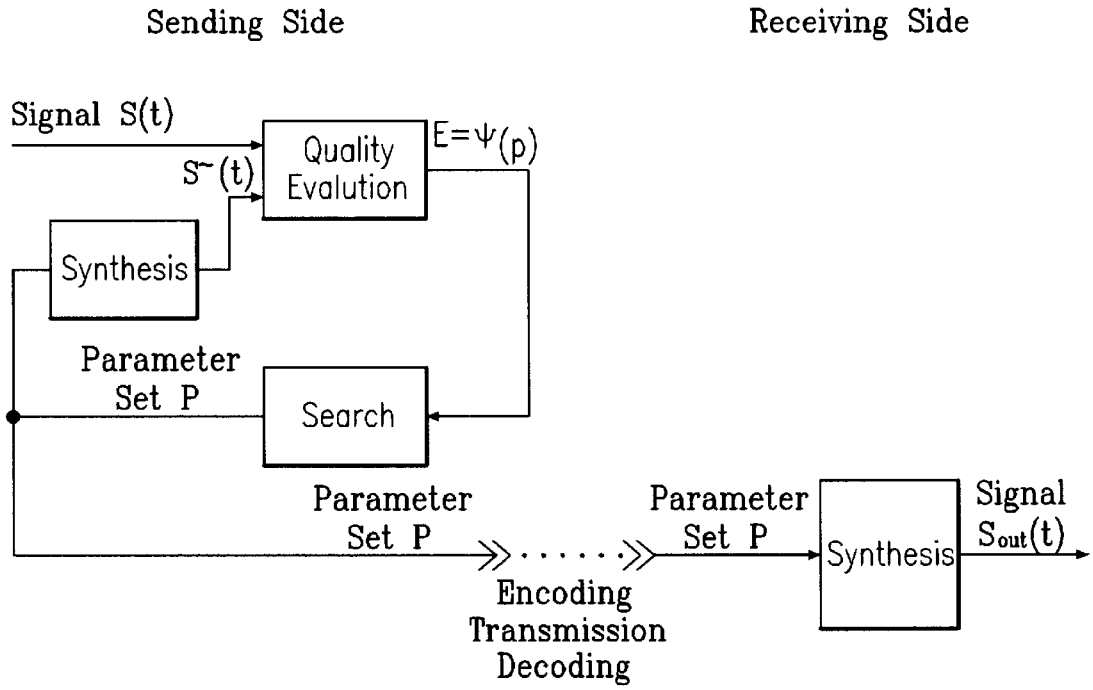
FIG. 4 illustrates an Analysis by Synthesis method of the speech model parameters determination according to the present invention.

The speech model parameters may simply be calculated or explicitly and then output to an encoder as shown in FIG. 3. However, the Analysis by Synthesis implicitly defines all the speech model parameters or a part of the parameters before outputting the parameters to the encoder. Referring to FIG. 4, a conceptual scheme of the AbS approach to the parameter determination includes a Quality Evaluation component, a Synthesis component and a Search component. An identical Synthesis component is used for both the speech generation at the sending side and at the receiving side. The set P model parameters is searched, providing a synthesized signal $\tilde{s}$ (t), which is closest to the real speech signal s(t) depending upon certain criterion. The search of the optimal set P can be carried out as an iterative process wherein the value of vector P varies at every iteration and the value of an object function $E=\Psi(M)$ is estimated. The optimal vector of the model parameters is subjected to encoding and is transmitted to the Synthesis component.

In one embodiment of the present invention, the spectral amplitudes are estimated using the AbS approach, based upon the pitch frequency value and the voiced/unvoiced decisions which were estimated by a direct calculation. The AbS approach for estimating the spectral amplitudes will be interpreted in terms defined above. At the sending side, a synthesis unit identical to the synthesis unit at the receiving side is used for the speech generation. Accordingly, the same rule for interpolation of the amplitude, phase and frequency from a previous frame to the current frame is used at both the sending and the receiving side.

Under a specified pitch value $f_0$ and a set of voiced/unvoiced decisions V, the set of spectral amplitudes M is searched, providing a synthesized signal $\tilde{s}(t)$ having a spectrum $\tilde{S}$, which is the closest to the real speech signal spectrum S. The criterion is a minimum SSE of the approximation spectrum S by the spectrum $\tilde{S}$. The search of the optimal spectral magnitudes can be carried out as an iterative process. At every iteration, the value of vector M varies, and the value of an object function $SSE=\Psi(M)$ is estimated. The optimal values found are subjected to the encoding and transmission.

In the preferred embodiment of the present invention, one-iteration of the magnitude determination is proposed because this scheme is suitable for a real time implementation. The magnitude determination according to the present invention is based on the linearity of the Fourier Transform and the linearization of speech signal processing.

A model set of the spectral magnitudes is formed by means of assigning a fixed value $M_m$=e (in particular, these values are equal to unit values: $M_m=1$) to every magnitude to be determined. Under specified pitch values $f_o^{ph}$, $F_o^c$ and the sets $V^p$, $V^c$ of voicing decisions for the previous and current frames, the model speech signal $\tilde{s}(t)$ is synthesized for the assigned etalon (unit) values of spectral amplitudes. The spectrum $\tilde{S}$ of the synthesized signal is calculated and compared with the spectrum $\tilde{S}$ of the real speech signal. Such comparison is separately performed in every band.

Similar to an analysis of a response of the unit disturbance in the linear system theory, a part of the spectrum $\tilde{S}_m$ related to the m-th band is interpreted as a response of the linearized system under the action of the m-th spectral component of unit amplitude. A part of real spectrum $S_m$ related to m-th band may be approximated as $$S_m=\mu\tilde{S}_m+E_m, \tag{5}$$

where $E_m$ is an error of approximation. The value $\mu_m$ may be found as the factor under which $S_m$ is approximated in the best way. Thus, the values $\mu$m for all bands are calculated using the Least Square Method.

As a result, the approximation coefficients, which minimize the summarized square error of approximation of the spectrum S by the spectrum $\tilde{S}$, are determined. By virtue of the linearity (or quasi-linearity) property, these multiplicative coefficients may be treated as the values of spectral magnitudes ($M_m=e\cdot\mu_m$ or $M_m1\cdot\mu_m$) for which the synthesized signal has the spectrum $\tilde{s}$ being closest to the spectrum S of the real speech signal. These values $\mu_m$ are subjected to encoding and transmitted. At the receiving side, the values are used for assigning the spectral amplitude values for the synthesis of the output speech signal.

Figure 5:
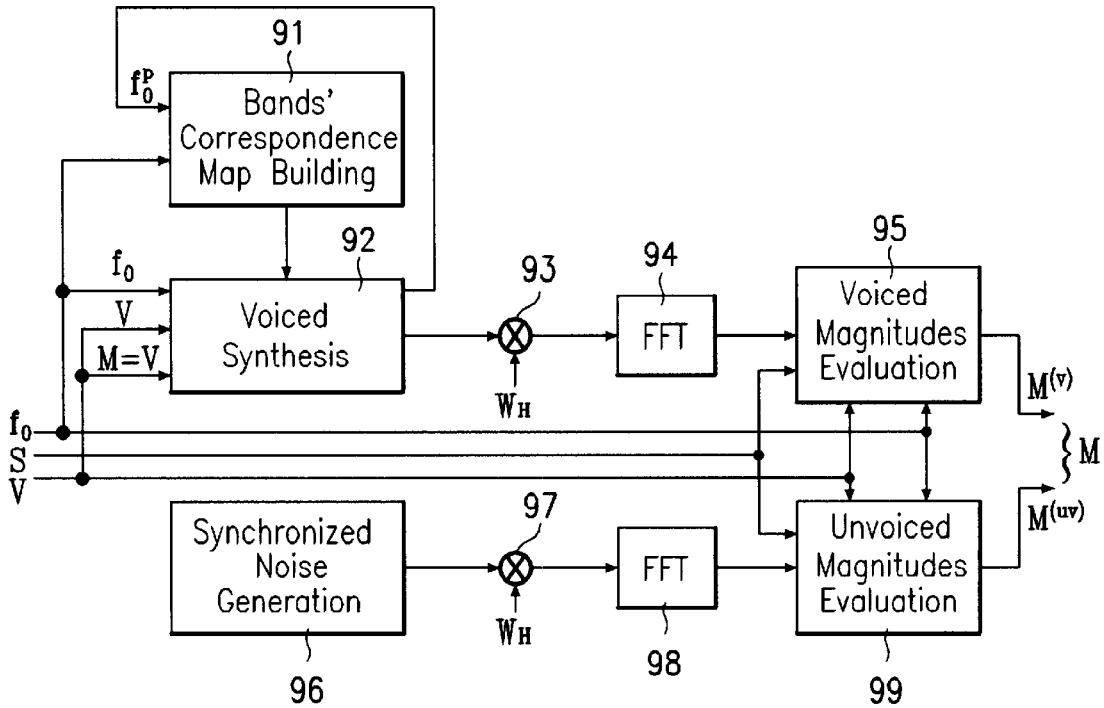
FIG. 5 is a block diagram of Analysis by Synthesis spectral magnitudes determination according to the present invention.
Figure 7:
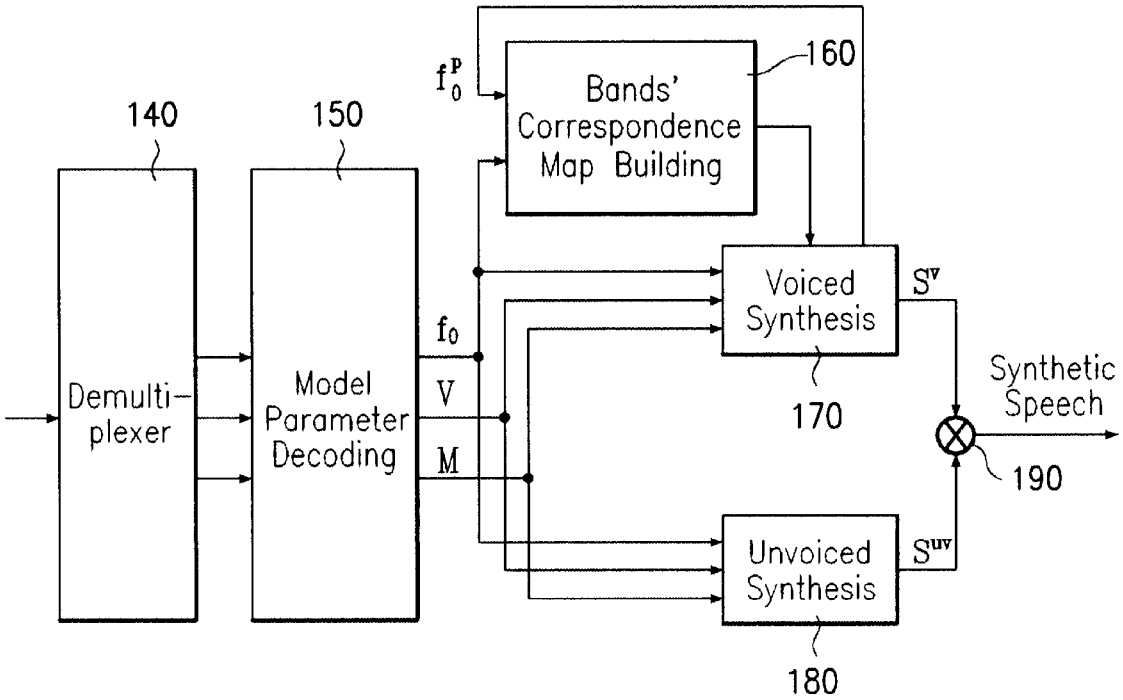
FIG. 7 is a block diagram of decoder according to the present invention.

A detailed block diagram of the spectral magnitude determination unit 90 according to the present invention is shown in FIG. 5. The computation of the voiced and unvoiced magnitudes is separately performed. Particularly, the calculation of the voiced spectral magnitudes is performed by a Bands' Correspondence Map Building unit 91, a Voiced Synthesis unit 92, a Hamming Windowing unit 93, a FFT unit 94, and a Voiced Magnitudes Evaluation unit 95. The Bands' Correspondence Map Building unit 91 and the Voiced Synthesis unit 92, used for the production of the voiced excitation spectrum, are identical with a Bands' Correspondence Map Building unit 160 and a Voiced Synthesis unit 170 used for the voiced speech synthesis at the decoder side, as shown in FIG. 7. As the excitation signal is synthesized at the encoder side in the way it is generated at the decoder side, the frequency response is very suitable to use as an approximating function.

As discussed above, the input parameter set for the Voiced Synthesis unit 92 includes a pitch frequency $f_o^c$ for the current frame, a voicing decision vector $V^c$ for the current frame, a spectral magnitude vector $M^c$ for the current frame, and a bands' correspondence map built by the Bands' Correspondence Map Building unit 91. A detailed operation of the Bands' Correspondence Map Building unit 91 and the Voiced Synthesis unit 92 will be described later in reference to the decoder side (See description of the Bands' Correspondence Map Building unit 160 and the Voiced Synthesis unit 170, correspondingly). However, it is necessary to note that these units synthesize the output speech signal in the time domain under a given input parameter set for a current frame and a similar parameter set $f_o^c$, $V^p$, $M^p$ for the previous frame which is stored in a Previous Frame Parameters Accumulator unit built-in into the Voiced Synthesis unit 92.

For the production of the voiced excitation spectrum, the spectral amplitudes for the voiced bands are determined by assigning fixed values, which are equal to one. Assuming that the components of voicing decision vector are equal to 1 for the voiced bands and are equal to 0 otherwise, the assignment can be written as $$M^c=V^c,\ M^p=V^p \tag{6}$$

Figure 14:
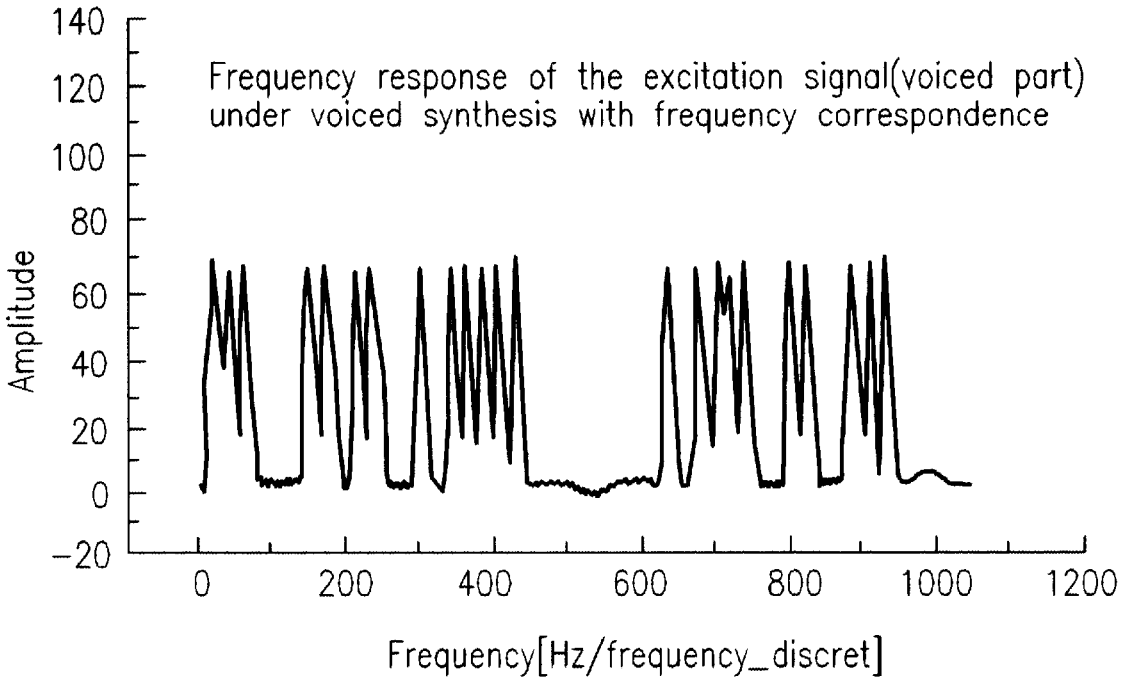
FIG. 14 is an example of the voiced excitation spectrum obtained by means of the voiced synthesis procedure according to the present invention.

The signal output by the Voiced Synthesis unit 92 is subjected to windowing by the Hamming Windowing unit 93 and to processing by the FFT unit 94. After the transformation, the output signal represents the voiced excitation spectrum $S^{v-e}$. An example of a voiced excitation spectrum obtained by the voiced synthesis procedure according to the present invention is shown in FIG. 14. The unvoiced part of the spectrum is nearly equal to zero while the voiced part of the spectrum has a regular structure. Even under the condition of changing pitch frequency and voicing decisions, the resulting spectrum would have similar properties, which are important for a correct spectrum approximation.

The voiced excitation spectrum obtained is used for a voiced magnitudes evaluation in the Voiced Magnitudes Evaluation unit 95. The Voiced Magnitudes Evaluation unit 95 performs a magnitudes estimation using the Least Square Method to approximate separately the voiced bands of real spectrum S by the excitation spectrum $S^{v-e}$. The position of the excitation spectrum clip relatively to the frequency band is tuned for the voiced frames by shifting the spectrum on both sides relatively to the band center. Afterwards, the position of an excitation spectrum clip providing the best NSR of approximation is selected for the magnitude evaluation, which is carried out by the Least Square Method.

The obtained set of voiced magnitude values $M^{(v)}$ is only a part of the M spectral magnitude vector. The set of unvoiced spectral magnitudes is the other part of the M spectral magnitude vector. A calculation of the unvoiced spectral magnitudes is performed by the Synchronized Noise Generation unit 96, the Hamming Windowing unit 97, the FFT unit 98, and the Unvoiced Magnitudes Evaluation unit 99 as shown in FIG. 5. The Synchronized Noise Generation unit 96 produces a white noise signal with an amplitude range of a unit. Similar to the process of obtaining the voiced magnitude values, the noise is processed in an identical manner at the encoder and the decoder side. Moreover, at the encoding side, a synchronizing property is provided which allows a better approximation of the unvoiced speech spectrum.

The signal obtained from the Synchronized Noise Generation unit 96 is windowed by the Hamming Windowing unit 97 and is processed by the FFT unit 98. In the Unvoiced Magnitudes Evaluation unit 99, the spectral magnitudes are calculated for every unvoiced band using the Least Square Method. The obtained set of unvoiced spectral magnitudes $M^{(uv)}$ is combined with the set of the voiced magnitudes $M^{(v)}$ to obtain the spectral magnitude vector M.

Referring back to FIG. 1, an encoding of the speech model parameters according to the present invention includes three parts. The encoding of the pitch frequency is performed by a Scalar Quantization unit 100. The pitch frequency value is restricted to the frequency range, for example $f_0$ [50,400] and quantized into 256 levels (8 bits). The maximum error of the pitch frequency representation for this case is 0.684 Hz. The determined quantized value is passed to the Multiplexer unit 130. Also, the vector V of the group voiced/unvoiced decisions is simply passed to the Multiplexer unit 130.

The vector M of the spectral magnitudes is encoded in two stages. First, a reduction of the spectral magnitudes vector is performed by a Spectral Magnitudes Wavelet Reduction unit 110. Second, a hybrid encoding of the spectral magnitudes vector reduced is carried out by a Spectral Magnitudes Hybrid Encoding unit 120. The reduction of the spectral magnitudes vector according to the present invention will be described in details.

First, a logarithm of the elements of the vector M is taken as expressed in the following formula:

$$M_i=log_{10}M_i,\ 0<i<m$$

Here, m defines dimension of the vector M. The value m depends on the pitch frequency and varies in time. Afterwards, a transformation of the vector $\tilde{M}$ of the dimension m to a vector $\tilde{M}^r$ of a fixed dimension r is performed. Taking into consideration a further usage of WT for encoding of the vector $\tilde{M}^r$, the number r can be chosen such that $r=l\cdot 2^n$, where l is a positive integer number, and n is a number of prospective steps of the above mentioned WT. In the preferred embodiment, the dimensionality of the vector $\tilde{M}$ is reduced to a value r=16 with n=3 and l=2.

The reduction operation is irreversible, but the described implementation provides a reconstruction of vector $\tilde{M}$ with high precision. If the dimension of vector $\tilde{M}$ is equal to r, there is no need in the reduction operation. For other case, a procedure comprising the following steps is performed:

- a cubic spline based on the elements of vector $\tilde{M}$ is built;
- a minimal number S is calculated such that $s=r\cdot 2k\geqq m$, k=0, 1, 2, . . . ;
- a new uniform grid with S nodes is built and the values of cubic spline are calculated in these nodes;
- k steps of Wavelet Transform are applied to the obtained set of s values;
- the resultant r low-pass wavelet coefficients are elements of vector $\tilde{M}^r$, while the high-pass coefficients are discarded.

The number k of WT steps at this stage is not fixed and can differ for different signal frames.

Figure 6:
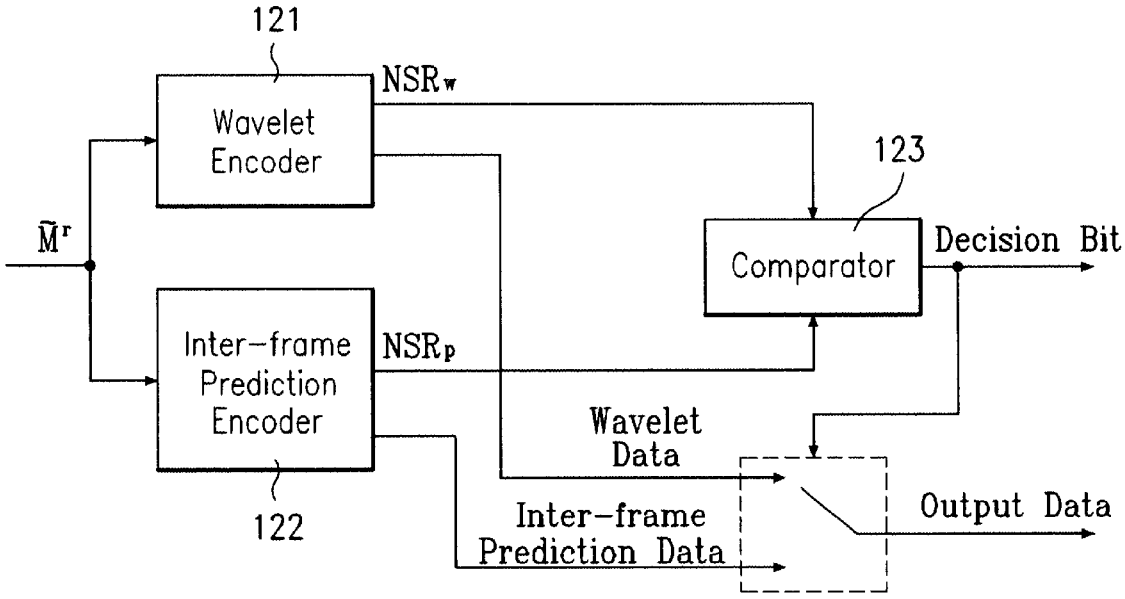
FIG. 6 is a block diagram hybrid encoding of the spectral magnitudes vector according to present invention.

Referring to FIG. 6, a hybrid encoding of the spectral magnitudes vector by the hybrid encoding unit 120 according to present invention will be described in details. The vector $\tilde{M}^r$ is subjected to two encoding, namely a wavelet scheme in a Wavelet Encoder unit 121 and an inter-frame prediction scheme in an Inter-frame Prediction Encoder unit 122. During the two encoding processes, the effectiveness of each scheme is simultaneously estimated using a NSR criterion and the best scheme is selected as a base encoding for the vector $\tilde{M}^r$ by a Comparator unit 123.

In the Wavelet Encoder unit 121, n steps of WT are applied to the vector $\tilde{M}^r$. Both l low-pass and r–l high-pass wavelet coefficients are subjected to quantization. A lattice quantization technique is used for encoding of the low-pass wavelet coefficients, while an adaptive scalar quantization is applied for the high-pass wavelet coefficients. A scalar quantizer symmetrical relatively to zero is built due to the nature of the high-pass wavelet coefficients. In the preferred embodiment, the number of WT steps n=3 and the number of the low-pass wavelet coefficients l=2. The biorthogonal (5,3) filters are used as the WT filters both at the reduction stage and at the encoding stage.

In the Inter-frame Prediction Encoder unit 122, an inter-frame prediction for encoding of the spectral magnitudes is used as a competing encoding scheme. The inter-frame prediction exploits a similarity of the spectral magnitudes in the neighbor frames and has a high effectiveness in the case of stationary signals. A prediction error is encoded using an adaptive scalar quantization.

Simultaneously with encoding, the decoding process takes place, which is necessary both for inter-frame prediction scheme operation and for quality estimation of test encoding schemes. The joint usage of competed encoding schemes such as Wavelet and Inter-Frame Prediction provides high effectiveness of the invented method. Thus, the Comparator unit 123 compares the effectiveness of the both schemes and dispatches a decision bit and data corresponding to the best scheme to the Multiplexer unit 130. The Multiplexer unit 130 combines the coded values of all parameters into an output plurality of bits and forms a bitstream.

FIG. 7 shows a block diagram of a decoder, which decodes the input bits and synthesizes a synthetic digital speech. The Demultiplexer unit 140 separates the input plurality of bits according to an accepted data structure. The Model Parameters Decoding unit 150 performs decoding of parameters, which determine the output speech. The Model Parameters Decoding unit 150 operates in an opposite manner to the model parameters encoding units (see the Scalar Quantization unit 100, the Spectral Magnitudes Wavelet Reduction unit 110, and the Spectral Magnitudes Hybrid Encoding unit 120).

A Bands' Correspondence Map Building unit 160 constructs the map, which forms the couples of the laced frequency bands by using the values of the pitch frequency for the current and previous frames. A voiced speech part is generated by a Voiced Synthesis unit 170 and the unvoiced speech part is generated by an Unvoiced Synthesis unit 180. A Summing unit 190 produces the synthetic digital speech by summing of the outputs the Voiced and Unvoiced Synthesis units 170 and 180.

The voiced part of a synthesized signal $S^v(n)$ is produced as a sum of the appropriate harmonic components expressed by $$S^v(n) = \sum_{m \in I^v} S_m^v(n), \tag{7}$$

where $S_m^v(n)$, n=0, . . . , L−1 is a harmonic component signal corresponding to the m-th frequency band, L is a length of the non-overlapped part of the speech frame, and $I^v$ is a set of frequency bands determined as the voiced bands.

Also, the harmonic component signal $S_m^v(n)$ can be expressed as follows using the time index (sample number) n within the frame:

$$S_m^v(n) = A_m(n)\mathrm{COS}(\theta_m(n)),\ n=0, \ldots, L-1, \tag{8}$$

where $A_m(n)$ indicates the amplitude of the m-th harmonic interpolated between the beginning and the end of the frame, and $\theta_m(n)$ denotes the phase of the harmonic signal.

Although there are key problems in speech synthesis such as in the interpolation of the harmonic amplitudes, the interpolation of the harmonic angular frequencies, and providing continuity of the harmonic phases, one of the most critical problems may arise by the interaction of the inter-frame frequency bands. In vocoders similar to the MBE vocoders, the harmonic components of the current frame are laced with the harmonic components of the previous frame for the synthesis implementation. In the related art, the harmonics relating to the same frequency band number of the neighboring speech frames were laced.

Figure 8:
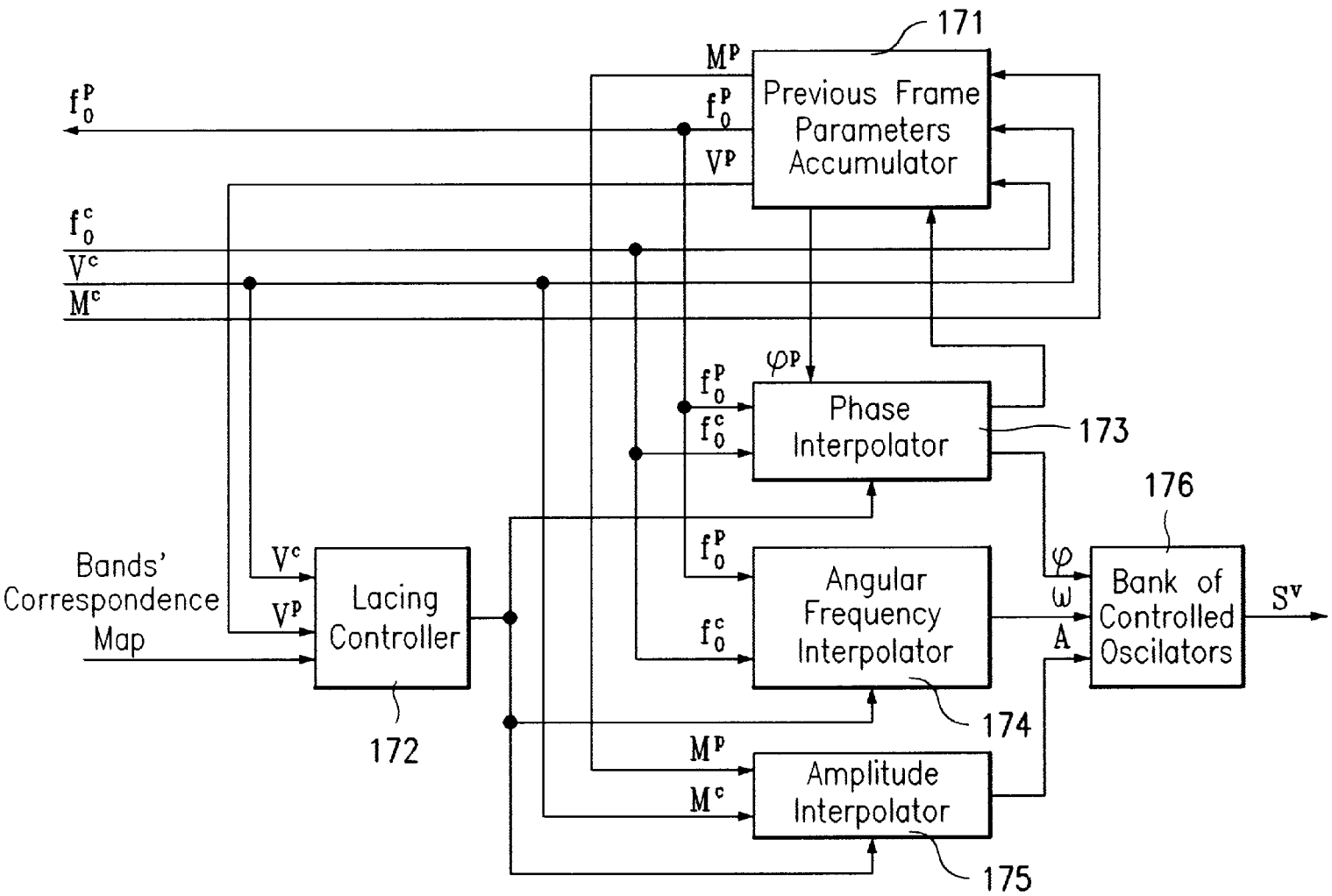
FIG. 8 is a block diagram of the voiced speech synthesis according to the present invention.

In the preferred embodiment of the voiced synthesis according to the present invention, the harmonics relating to nearly the same frequencies are laced on the basis of a built map of the frequency bands correspondence. A detailed block diagram of the voiced speech synthesis 170 according to the present invention is shown in FIG. 8.

The input parameter set for voiced speech synthesis includes a pitch frequency $f_o^c$, a voicing decision vector $V^c$, and a spectral magnitude vector $M^c$ for the current frame, and a bands' correspondence map built by the Bands' Correspondence Map Building unit 160. A set of parameters $f_o^p$, $V^p$, $M^p$ of the previous frame, which is stored in a Previous Frame Parameters Accumulator unit 171, is also used for the speech synthesis. A Lacing Controller unit 172 regulates the operation of a Phase Interpolator unit 173, an Angular Frequency Interpolator unit 174 and an Amplitude Interpolator unit 175 by choosing the approximation type depending on the voicing states of the laced bands. A Bank of Controlled Oscillators unit 176 provides the voiced speech synthesis using equation (7).

Figure 9:
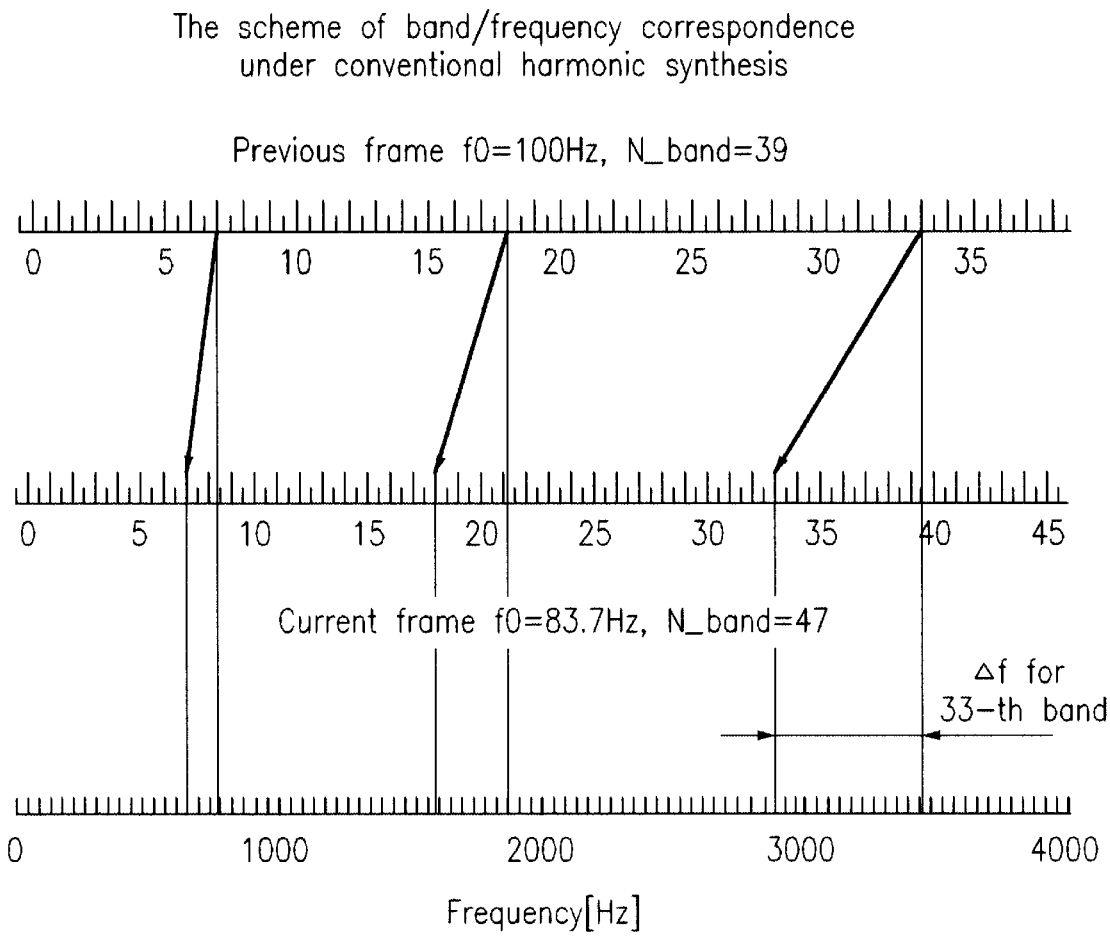
FIG. 9 an example of the band/frequency correspondence under the conventional voiced speech synthesis in a related art.

The significant distinction of the present invention lies in the presence of the Bands' Correspondence Map Building unit 160, which determines the way for the harmonic lacing. In the related art, the harmonics relating to the same frequency band number of the neighboring speech frames are laced. An example of a band/frequency correspondence under the harmonic synthesis in the related art is shown in FIG. 9. The pitch frequency of the previous frame is equal to 100 Hz while the pitch frequency of the current frame is equal to 83.7 Hz and the number of bands of the previous frame is equal to 39 while the number of bands of the current frame is equal to 47. As shown, a small pitch frequency change leads to a large frequency variation, especially for large harmonic numbers.

Figure 10:
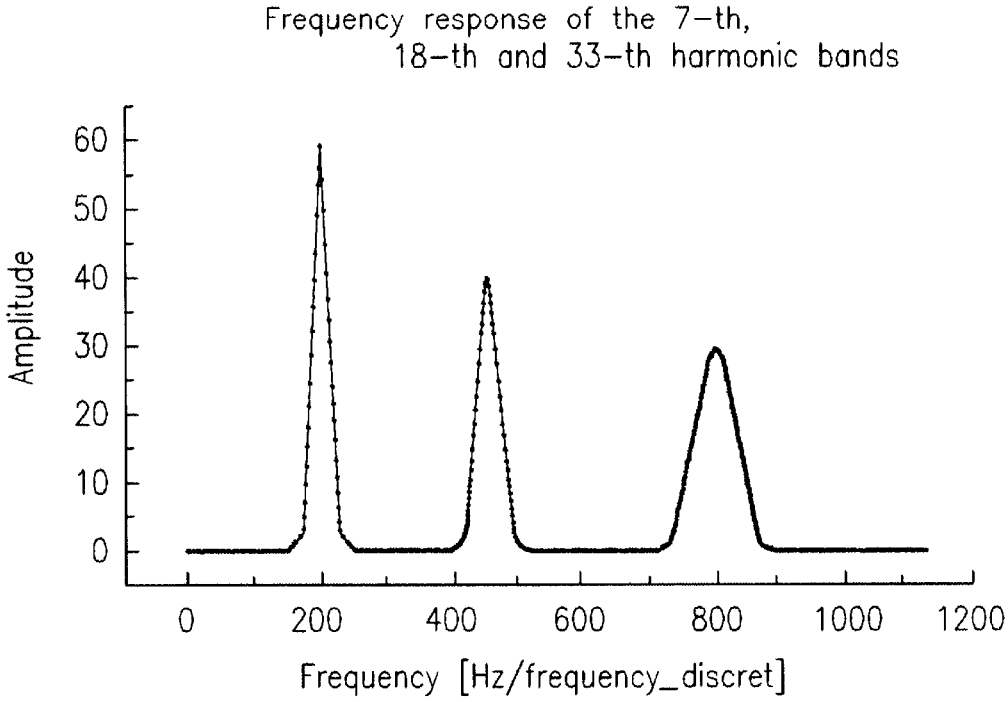
FIG. 10 illustrates frequency responses of some bands under the conventional voiced speech synthesis in a related art.
Figure 11:
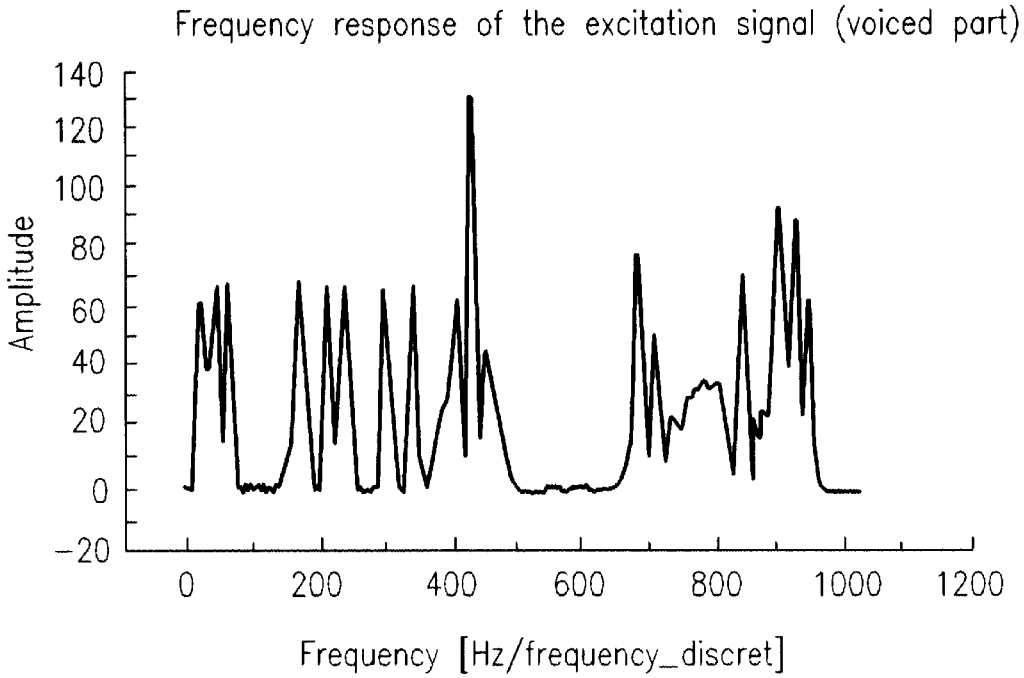
FIG. 11 is an example of the excitation spectrum under the conventional voiced speech synthesis in a related art.

In FIG. 10, the frequency responses of the 7th, 18th and 33rd harmonic bands according to the related art are shown. These bands are voiced for both the current and previous frames. Under above-mentioned correspondence of harmonic bands, the frequency difference of the laced harmonics (for example, the 7th, 18th, 33rd bands in FIG. 10) causes a difference in amplitude and width frequency responses. This leads to an interaction of different frequency band responses and to a distorted shape of the excitation spectrum as shown in FIG. 11. Moreover, if the pitch jumps, annoying artifacts appear in the decoded speech.

Figure 12:
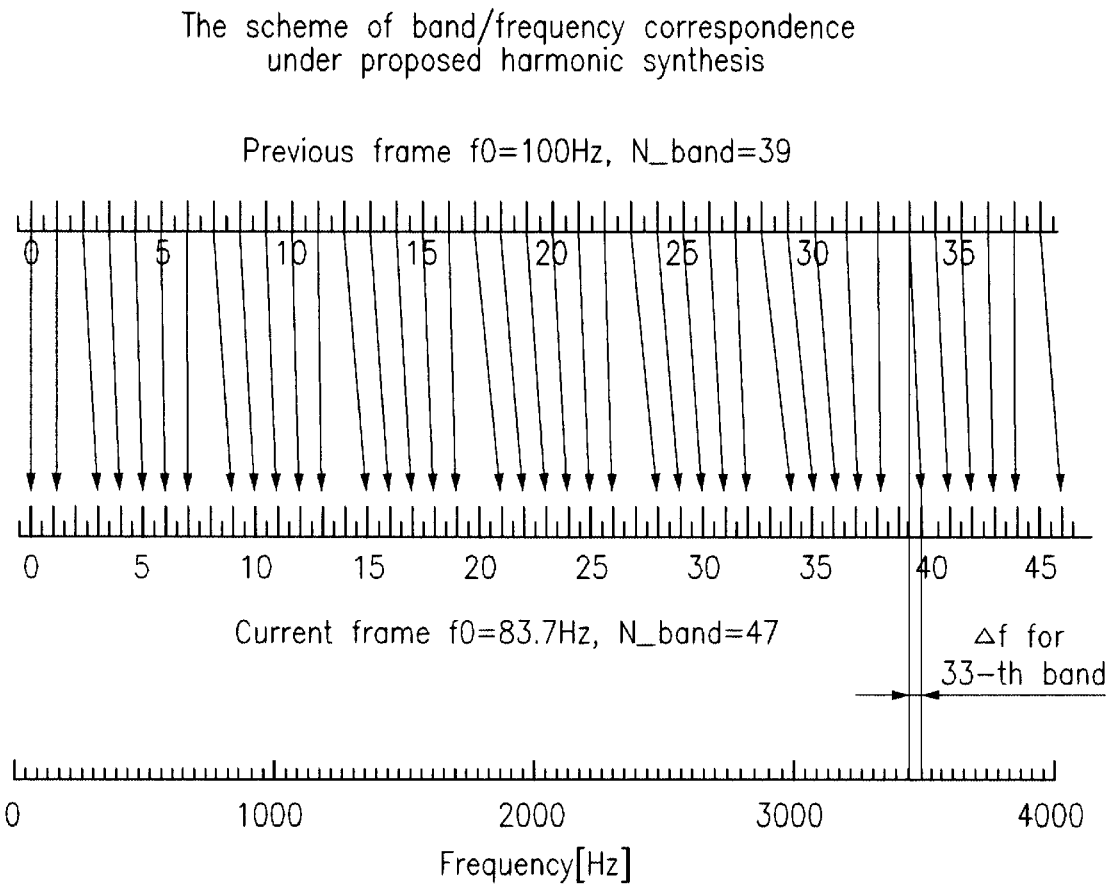
FIG. 12 is an example of the band/frequency correspondence for the voiced speech synthesis scheme according to the present invention.

An example of a band/frequency correspondence under the harmonic synthesis according to the present invention is shown in FIG. 12. The harmonic synthesis is performed on the base of direct and inverse maps, which give the correspondence between the frequency bands of the current and previous frames. As shown, the numbers of bands for correspondence may be different, but the bands' frequencies differ little both in the beginning and in the end of a frequency range (see Δf for the 33 band in FIG. 12).

Figure 13:
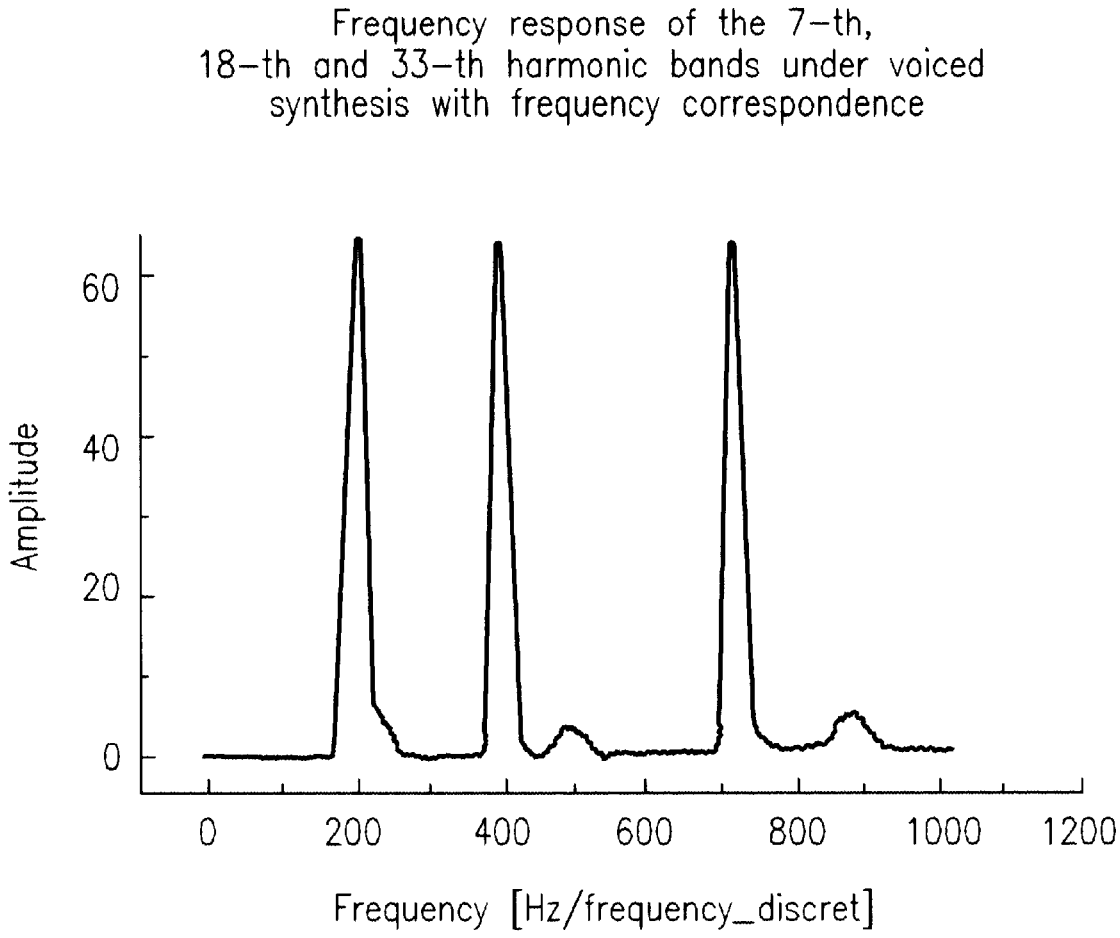
FIG. 13 illustrates frequency responses of some bands to the voiced speech synthesis scheme according to the present invention.

The frequency responses for the 7th, 18th and 33rd harmonic bands according to the present invention are shown in FIG. 13 and as shown the harmonic bands have the same amplitude and width. The little hillocks near the main peaks correspond to the fading of the harmonics of the previous frame. The frequency response of the excitation signal is given in FIG. 14, which has a regular structure. It is important to note that the different bands are not overlapped and do not interact under the constructing of the excitation signal. This leads to a more correct and reliable evaluation of the amplitude without dramatic consequences due to a change in the pitch frequency.

Thus, couples of harmonics with the closest frequencies in the current and previous frames are selected and laced. The harmonics of previous frame which are not laced are smoothly decreased up to a zero amplitude and the harmonics of the current frame not laced are smoothly increased up to the determined amplitude.

The following notation will be used for the description of the present invention below. For the frequency bands $m_c$ and $m_p$ in the current and previous frames, $m_c=\phi(m_p)$ or $m_p=\phi^1(m_c)$. If a frequency band $m_c$ in the current frame (or $m_p$ in previous frame) is determined as voiced, $m_c \epsilon I_c^v$ or $m_p \epsilon I_p^v$. If a frequency band $m_c$ or $m_p$ is determined as unvoiced, $m_c \notin I_c^v$ or $m_c \notin I_p^v$. Let $f_0^c$ be a pitch frequency for the current frame ($\omega_0^c=2f_0^c$); and let $N_c$ be a number of frequency bands ($N_c=f_d/(2f_0^c)$, where $f_d$ is a value of sampling frequency). Then, $\{M_{mc}\}$, $m_c=0, \ldots, N_c-1$ is a set of magnitudes for every frequency band and $I_c^v$ is a set of frequency bands which are determined as the voiced bands. Similarly for the previous frame, $f_0^p$; $N_p$; $\{M_{mp}\}$, $m_p=0, \ldots, N_p-1$; and $I_p^v$ are the pitch frequency, the number of frequency bands, the set of magnitudes and the set of voiced frequency bands.

The voiced speech synthesis is performed by the Bank of Controlled Oscillator unit 176 as shown in FIG. 8. The operation of the Bank of Controlled Oscillator unit 176 may be expressed by the following formulas. If the pitch frequency is increasing, $f_o^c>f_o^p$, i.e. $N_c<N_p$, the voiced part of the synthesized signal S(in) is calculated by summing along all the appropriate bank couples $M=0, \ldots, N_p-1$ as follows:

$$S^v(n) = \sum_{m=0}^{N_p-1} S_m^v(n), \tag{9}$$

where m is a band couple number. The m-th band couple $<m_p, m_c>$ consists of the $m_p$ band and the $m_c$ band, where $m_p=m$ and $m_c=\phi(m_p)$. Here, $\phi(.)$ is a direct map which gives the correspondence between the frequency bands of the previous and current frames.

If the pitch frequency is decreasing, $f_o^c<f_o^p$, i.e. $N_c>N_p$, the voiced part of the synthesized signal $S^v(n)$ is calculated by summing along all the appropriate band couples $m=0, \ldots, N_c-1$ and is written as equation (10) below.

$$S^v(n) = \sum_{m=0}^{N_c-1} S_m^v(n), \tag{10}$$

The m-th band couple $<m_p, m_c>$ consists of the $m_p$ band and the $m_c$ band, where $m_c=m$, $m_p=\phi^{-1}(m_c)$. The function $\phi^{-1}(.)$ is an inverse map, which gives the correspondence between the frequency bands of the current and previous frames.

If the pitch frequency is steady, $f_0^c=f_0^p$, i.e. $N_c=N_p=N$, the voiced part of the synthesized signal $S^v(n)$ may be calculated without any map as follows:

$$S^v(n) = \sum_{m=0}^{N-1} S_m^v(n), \tag{11}$$

The Lacing Controller unit 172 regulates the operation of the Phase Interpolator unit 173, the Angular Frequency Interpolator unit 174, and the Amplitude Interpolator unit 175. There are three possible modes of interpolation depending on the voicing state of the laced bands. If the conditions $m_c \epsilon I_c^v$ and $m_p \epsilon I_p^v$ are satisfied for the m-th band couple $<m_p, m_c>$, a continuous harmonic is generated. The amplitude interpolation is carried out by the following formula:

$$A_m(n) = \begin{cases} M_{m_p} + n \cdot (M_{m_c} - M_{m_p}) / R, & \text{if } n < R \\ M_{m_c}, & \text{otherwise} \end{cases} \tag{12}$$

Here, $M_{mp}$ and $M_{mc}$ are magnitude values for the previous and current frames related to the $m_p$ and $m_c$ bands; $n=0, \ldots, L-1$ is a sample number; L is the length of the non—overlapped part of the speech frame; and R is a length of a racing interval ($0<R<L$).

The interpolation of a phase and an angular frequency is carried out according to formulas:

$$\theta_m(n)=n\omega_{m_p}+n\Delta\omega/2+\phi_{m_c}(0), \tag{13}$$

where $$\omega_{m_p}=(m_p+1)\cdot 2\pi\cdot f_0^p/f_d;$$

$$\omega_{m_c}=(m_c+1)\cdot 2\pi\cdot f_0^c/f_d;$$

$$\Delta\omega=(\omega_{m_c}-\omega_{m_p})/L; \text{ and}$$

where $\phi_{mc}(0)$ denotes the phase of the $m_c$-th harmonic at the beginning of the current frame which is equal to the phase of the corresponding harmonic at the end of the non-overlapped part of the previous frame, i.e. $\theta_{mc}(0)=0_{mp}(L)$.

If $m_c \epsilon I_c^v$ and $m_p \epsilon I_p^v$ for the m-th band couple $<m_p, m_c>$, a fading harmonic is generated and the interpolation is carried out by equations (14), (15) below.

$$A_m(n) = \begin{cases} M_{m_p} - M_{m_p} \cdot n / R, & \text{if } n < R \\ 0, & \text{otherwise} \end{cases} \tag{14}$$

$$\theta_m(n)=n\omega_{m_p}+\theta_{m_p}(L) \tag{15}$$

If $m_c \epsilon I_c^v$ and $m_{p \notin Ip}^v$ for the m-th band couple $<m_p, m_c>$, a rising harmonic is generated and the interpolation of the harmonic amplitudes is carried out by equations (16), (17) below.

$$A_m(n) = \begin{cases} M_{m_c} \cdot n / R, & \text{if } n < R \\ M_{m_c}, & \text{otherwise} \end{cases} \tag{16}$$

$$\theta_m(n)=n\omega_{m_c}+\phi_{m_c}(0), \tag{17}$$

where $\phi_{mc}(0)$ denotes the phase of the $m_c$-th harmonic at the beginning of the current frame which is equal to an initial phase value $\phi_0$.

Figure 15:
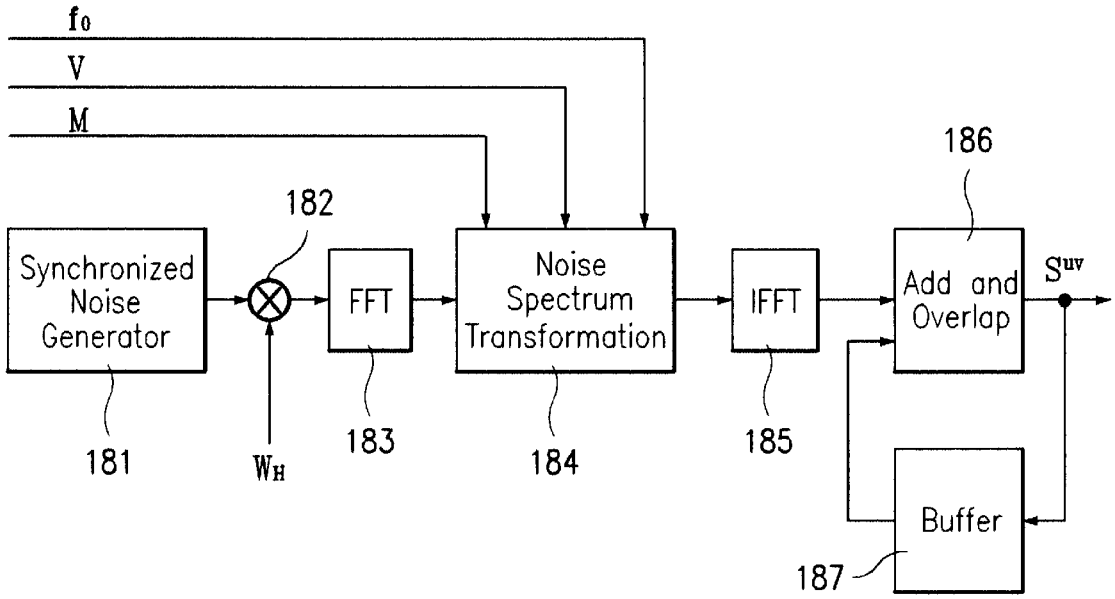
FIG. 15 is a block diagram of the unvoiced speech synthesis according to the present invention.

FIG. 15 shows a block diagram of the unvoiced speech synthesis 180 which according to the present invention includes a Synchronized Noise Generator unit 181 at the decoder side synchronized with the same unit 96 at the encoder side. Thus, the noise used for synthesis by the decoder is identical to the noise used for analysis by the encoder. A white noise signal waveform on the time axis, which was obtained from a white noise generator, is windowed by the Hamming Windowing unit 182. The result is processed by the FFT unit 183. The spectrum of the noise signal is multiplied by magnitudes Mm of the bands determined as unvoiced, whereas the amplitude of the voiced bands are set to zero.

The spectrum transformation is performed by the Noise Spectrum Transformation unit 184. The transformed spectrum is subjected to an inverse fast Fourier transform by an IFFT unit 185 using the phase values of the original noise signal. Afterwards, in an Add and Overlap unit 186, the obtained noise signal is overlapped with the noise signal of the previous frame stored by a Buffer 187 to produce an unvoiced speech part. In the Summing unit 190, the synthetic digital speech is produced by summing of the voiced and unvoiced speech parts.

The foregoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. An Analysis by Synthesis method for determining the spectral envelope information in speech coding systems based. on synthesizing a synthetic digital speech signal from a data structure produced by dividing an initial speech signal into a plurality of frames, determining a pitch frequency, determining voicing information, representing whether each of a plurality of frequency bands of each frame should be synthesized as voiced or unvoiced frequency bands, and processing the frames to determine spectral envelope information representative of the magnitudes of a spectrum in the frequency bands, wherein the method of determining the spectral envelope information comprises the steps of:

a) forming a model set of the spectral magnitudes by assigning fixed values;

b) synthesizing a model speech signal for the model set of the spectral magnitudes using both pitch frequencies and a set of voicing decisions determined for previous and current frames;

c) calculating a spectrum of the model speech signal;

d) approximating a spectrum of the initial speech signal by the spectrum of the model speech signal; and e) encoding coefficients obtained from the approximated spectrum.

2. A method of claim 1, wherein in the step (a), the model set of the spectral magnitudes are formed separately for voiced and unvoiced parts of the model speech signal spectrum.

3. A method of claim 2, wherein in the step a), a model set of the spectral magnitudes for the voiced part of the model speech signal spectrum is formed by assigning a fixed value equal to 1 during voiced bands and 0 otherwise.

4. A method of claim 2, wherein in the step d), the voiced part of the model speech signal spectrum is approximated by position tuning a voiced excitation spectrum clip relatively to a frequency band position using a Least Square Method.

5. A method of claim 2, wherein in the step b), the unvoiced part of the model speech signal spectrum is synthesized by producing a white noise signal of unit amplitude range and providing a synchronization property of the synthesis scheme.

6. A method of claim 2, wherein in the step d), the unvoiced part of the model speech signal spectrum is approximated by an unvoiced excitation spectrum clip for every frequency band using a Least Square Method.

7. A hybrid method for spectral magnitudes encoding of each speech frame, comprising the steps of:

a) reducing a number of spectral magnitudes;

b) using different types of encoding schemes for simultaneously encoding the spectral magnitudes;

c) evaluating the encoding schemes; and d) selecting from the evaluated encoding schemes the best encoding scheme for spectral magnitudes encoding as a base scheme.

8. A method of claim 7, wherein in the step a), the number of the spectral magnitudes is reduced based upon a Wavelet Transform technique.

9. A method of claim 8, wherein in the step b), the different types of encoding schemes include the Wavelet Transform technique and an inter-frame prediction.

10. A method for synthesizing a synthetic digital speech signal from a data structure produced by dividing an initial speech signal into a plurality of frames, determining a pitch frequency, determining voicing information, representing whether each of a plurality of frequency bands of each frame should be synthesized as voiced or unvoiced frequency bands, and processing the frames to determine spectral envelope information representative of the magnitudes of a spectrum in the frequency bands, wherein the method for synthesizing the synthetic digital speech signal comprises the steps of:

a) building a frequency correspondence between bands of current and previous frames;

b) synthesizing speech components for the voiced frequency bands for couples of harmonics with the closest frequencies in the current and previous frames utilizing the built bands' frequency correspondence and lacing the coupled harmonics, wherein all uncoupled harmonics of the previous frame are smoothly decreased down to zero amplitude and wherein all uncoupled harmonics of the current frame are smoothly increased up to their own amplitudes;

c) synthesizing speech components for the unvoiced frequency bands; and d) synthesizing the synthetic digital speech signal by combining the synthesized speech components for the voiced and the unvoiced frequency bands.

11. A method of claim 10, wherein in the step a) the bands' frequency correspondence is built by forming direct and inverse maps of the frequency bands induced by the pitch frequency of the previous and current frames.

12. A system for speech signal coding and decoding, comprising a speech signal coder and a speech signal decoder, wherein the speech signal coder comprises:

a processor dividing an input digital speech signal into a plurality of frames to be analyzed in time and frequency domains;

an orthogonal transforming unit transforming each frame to provide spectral data on the frequency axis;

a pitch determination unit determinating a pitch frequency for each frame;

a voiced/unvoiced discrimination unit generating group voiced/unvoiced decisions utilizing the determined pitch frequencies;

a spectral magnitudes determination unit estimating spectral magnitudes by utilizing an Analysis by Synthesis method; and a parameter encoding unit encoding the determined pitch frequency, the estimated spectral magnitude and the voiced/unvoiced decisions for each of the plurality of frames, and combining encoded data into a plurality of bits; and wherein the speech signal decoder comprises:

a parameters decoding unit decoding the plurality of bits to provide the pitch frequency, spectral magnitudes and voiced/unvoiced decisions for each of the plurality of frames;

a bands' frequency correspondence map building unit building a bands' frequency correspondence map between bands of current and previous frames; and a signal synthesizing unit synthesizing a speech signal from the pitch frequency, spectral magnitudes and voiced/unvoiced decision, and utilizing the bands' frequency correspondence map.

13. A system of claim 12, wherein the speech signal coder further comprises:

a frame classification unit classifying and assigning a frame classification to each frame in the time domain by range and character of varying signal value along the frame and by characters of a signal oscillation in first and second parts of the frame; and wherein the voiced/unvoiced discrimination unit generates group voiced/unvoiced decisions based upon the assigned frame classification.

14. A system of claim 13, wherein the voiced/unvoiced discrimination unit utilizes an adaptive threshold depending on the assigned frame classification.

15. A system of claim 13, wherein the pitch determination unit comprises:

a pitch candidates set determination unit determining a set of pitch candidates based upon an analysis of normalized auto-correlation function using either a direct or an inverse order depending on the assigned frame classification;

a best candidate selection unit estimating the set of pitch candidates in the frequency domain and selecting the best candidate from the set of pitch candidates; and a best candidate refinement unit refining the selected best candidate in the frequency domain.

16. A system of claim 15, wherein the best candidate selection unit estimates the set of pitch candidates by a window function response scaled to obtain a predetermined sharpness of the window function in each band and to provide a final pitch candidate selection.

17. A system of claim 16, wherein the window function response is scaled for pitch frequencies lower than a predetermined frequency $F_{scale}$.

18. A system of claim 17, wherein the window function response is scaled by a procedure of proportional sharpening.

19. A system of claim 18, wherein the procedure of proportional sharpening is carried out by a linear interpolation.

20. A system of claim 19, wherein the window function responses scaled for different pitch frequencies are used as a look-up table.

21. A system of claim 12, wherein the parameter encoding unit further comprises:

a scalar quantization unit quantizing a value of the pitch frequency;

a spectral magnitudes wavelet reduction unit reducing a dimension of a spectral magnitude vector;

a spectral magnitudes hybrid encoding unit encoding the reduced a spectral magnitudes vector by a wavelet technique; and a multiplexer unit combining the encoded data into a plurality of bits.

22. A system of claim 21, wherein the spectral magnitudes hybrid encoding unit comprises:

a wavelet encoder unit encoding the reduced spectral magnitudes vector;

an inter-frame prediction encoder unit encoding the reduced spectral magnitudes vector; and a comparator unit comparing the effectiveness of the wavelet encoder unit and the effectiveness of the inter-frame prediction encoder unit to select a better encoder unit, and outputting a decision bit and data corresponding to the selected better encoder unit to the multiplexer unit.

23. A system of claim 12, wherein the signal synthesizing unit comprises:

a voice synthesizing unit synthesizing speech components for voiced frequency bands for couples of harmonics with the closest frequencies in the current and previous frames utilizing the built bands' frequency correspondence and lacing the coupled harmonics, wherein all uncoupled harmonics of the previous frame are smoothly decreased down to zero amplitude and wherein all uncoupled harmonics of the current frame are smoothly increased up to their own amplitudes;

an unvoiced synthesis unit synthesizing speech components for unvoiced frequency bands; and an adder synthesizing the speech signal by summing the synthesized speech components for the voiced and the unvoiced frequency bands.

24. A system of claim 12, wherein the spectral magnitudes determination unit comprises:

a bands' frequency correspondence map building unit building a frequency correspondence between bands of current and previous frames;

a voiced synthesis unit synthesizing a model voiced signal for a model set of the spectral magnitudes based upon the built bands' frequency correspondence, the pitch frequency and the set of voicing decisions for the previous and current frames;

a first windowing unit processing the model voiced signal;

an orthogonal transforming unit transforming a model voiced signal windowed by the first windowing unit into a frequency domain;

a voice magnitude evaluation unit evaluating voiced magnitudes of the transformed model voiced signal by a Least Square Method;

a synchronized noise generator producing a model white noise signal with a unit amplitude range;

a second windowing unit processing the model white noise signal;

an orthogonal transforming unit transforming the model white noise signal windowed by the second windowing unit to a frequency domain; and an unvoiced magnitudes evaluation unit evaluating unvoiced magnitudes of the transformed model white noise signal by a Least Square Method.

25. A system of claim 24, wherein the voiced synthesis unit forms the model voiced signal for the model set of the spectral magnitudes by assigning fixed etalon values equal to 1 for voiced bands and 0 otherwise.

26. A system of claim 12, wherein the voiced/unvoiced discrimination unit generates the group voiced/unvoiced decisions utilizing a window function response scaled to obtain a predetermined sharpness of the window function in each band and to provide a final voiced/unvoiced decisions generation.

27. A system of claim 26, wherein the window function response is scaled for pitch frequencies lower than a predetermined frequency $F_{scale}$.

28. A system of claim 27, wherein the window function response is scaled by a procedure of proportional sharpening.

29. A system of claim 28, wherein the procedure of proportional sharpening is carried out by a linear interpolation.

30. A system of claim 29, wherein the window function responses scaled for different pitch frequencies are used as a look-up table.

31. A system of claim 30, wherein the voiced/unvoiced discrimination unit tunes a position of said scaled responses relative to the location of a frequency band peak.

* * * * *